US005459279A

United States Patent [19]

Okamoto

[11] Patent Number: 5,459,279

[45] Date of Patent: Oct. 17, 1995

[54] ELECTRONIC INSTRUMENT FOR GENERATING SOUNDS BASED ON THE COMPRESSED WAVEFORM DATA STORED BEFOREHAND

[75] Inventor: Seiji Okamoto, Hamamatsu, Japan

[73] Assignee: Kabushiki Kaisha Kawai Gakki Seisakusho, Japan

[21] Appl. No.: 252,076

[22] Filed: Jun. 1, 1994

[30] Foreign Application Priority Data

Jun. 2, 1993 [JP] Japan ..... 5-132110

[51] Int. Cl.[6] ..... G10H 7/02

[52] U.S. Cl. ..... 84/604

[58] Field of Search ..... 84/603–607

[56] References Cited

U.S. PATENT DOCUMENTS 5,329,062 7/1994 Kaneko ..... 84/604 X

*Primary Examiner*—Stanley J. Witkowski

*Attorney, Agent, or Firm*—Davis, Bujold & Streck

[57] ABSTRACT

In an electronic instrument, sound waveform is compressed for efficient storage, while quick response from the depressing of keys till the sounding is assured. The electronic instrument is provided with the waveform ROM for storing the waveform of the start of sounding without compressing. The subsequent waveform is compressed and stored in the waveform ROM. The sound source system having a waveform reproducing portion is also provided for developing the compressed stored waveform. The electronic instrument is further provided with a waveform RAM for temporarily storing the waveform developed by the waveform reproducing portion. When the keys of the electronic instrument are depressed, sounds are generated at first based on the uncompressed waveform data, and the compressed waveform data is concurrently developed in the waveform RAM. After all the uncompressed waveform data is read from the waveform ROM, sounds are subsequently generated based on the waveform data developed by the waveform RAM. The data used immediately after the keys are depressed is not compressed, thereby assuring quick response to the depressing of keys.

9 Claims, 4 Drawing Sheets

ELECTRONIC INSTRUMENT FOR GENERATING SOUNDS BASED ON THE COMPRESSED WAVEFORM DATA STORED BEFOREHAND

FIELD OF THE INVENTION

This invention relates to an electronic instrument which generates sounds of various tones based on the compressed sound waveform data stored beforehand.

BACKGROUND OF THE INVENTION

In a conventional electronic instrument, the sound waveforms of various instruments are transformed to the numerical waveform data in the pulse code modulation system. The numerical waveform data is stored in a memory and various tones are reproduced based on the numerical waveform data. In the electronic instrument, when almost the actual instrumental sounds or the sound of more various tones are generated, a volume of sound waveforms sampled from actual instruments need to be stored in ROM or other memory in advance. Practically, however, memory cannot be increased limitlessly, and the capacity of memory is restricted in terms of costs.

Various systems other than the pulse code modulation system are known as the system for transforming sound waveforms into numerical data for storage. For example, in the field of information processing, the adaptive differential pulse code modulation system, the vector quantization system or other system is known. In such systems, when sound waveforms are transformed into numerical waveform data, the data is compressed. The volume of data to be stored can be reduced, while the impairment in the quality of the data is minimized.

In the electronic instrument, however, the system for compressing the data for storage is disadvantageous as follows.

The compressed waveform data requires to be processed in use for the reproduction of sounds. The waveform data, compressed and converted according to a specified rule, is computed such that the conversion of the waveform data is inverted, and the inverted waveform data is developed. Thus, the initial waveform data prior to the compression can be reproduced. The development of waveform data takes time. Therefore, even if the development of waveform data is started at the same time when keys are depressed, response time is required between the key depressing and the sounding. Such response time gives the feeling of timing incompatibility to a player. Furthermore, when the performance is played very fast, the sounding fails to follow the key operation.

Consequently, although the vector quantization or other system for compressing data for storage is practical in the fields other than music, such system cannot be applied to the electronic instrument, in which quick response is essential for the data processing.

SUMMARY OF THE INVENTION

Wherefore, an object of this invention is to provide an electronic instrument which can sound with a quick response to the depressing of keys even if waveform data is compressed for the efficient storage.

To attain this or other object, the invention provides an electronic instrument provided with a compressed waveform memory, a waveform reproducing unit and a sounding unit, for sounding various tones based on the waveform data stored in advance. Sound waveform is stored as the compressed numerical data in the compressed waveform memory. By developing the compressed numerical data stored in the compressed waveform memory, sound waveform is reproduced by the waveform reproducing unit. Based on the sound waveform reproduced by the waveform reproducing unit, sounds are generated by the sounding unit. The electronic instrument is further provided with an initial waveform memory for storing the sound waveform at the start of sounding without compressing the sound waveform. The sounding unit generates sounds at first based on the sound waveform stored in the initial waveform memory, and subsequently based on the sound waveform reproduced by the waveform reproducing unit.

In the electronic piano having the aforementioned structure, at first, the sounding unit generates sounds based on the sound waveform stored in the initial waveform memory. The sounding quickly starts, because the uncompressed waveform data is stored in the initial waveform memory.

Concurrently with the start of sounding, the compressed numerical data stored in the compressed waveform memory is developed by the waveform reproducing unit, thereby starting the development of sound waveform. The sounding unit generates sounds based on the sound waveform reproduced by the waveform reproducing unit, subsequent to the sound waveform stored in the initial waveform memory. While the sounding is performed based on the sound waveform reproduced by the waveform reproducing unit, the compressed waveform data is developed successively by the waveform reproducing unit. Therefore, sounds can be continuously generated by the sounding unit.

BRIEF DESCRIPTION OF THE DRAWINGS

The invention will now be described, by way of example, with reference to the drawings, in which.

DETAILED DESCRIPTION OF THE PREFERRED EMBODIMENTS

Figure 1:
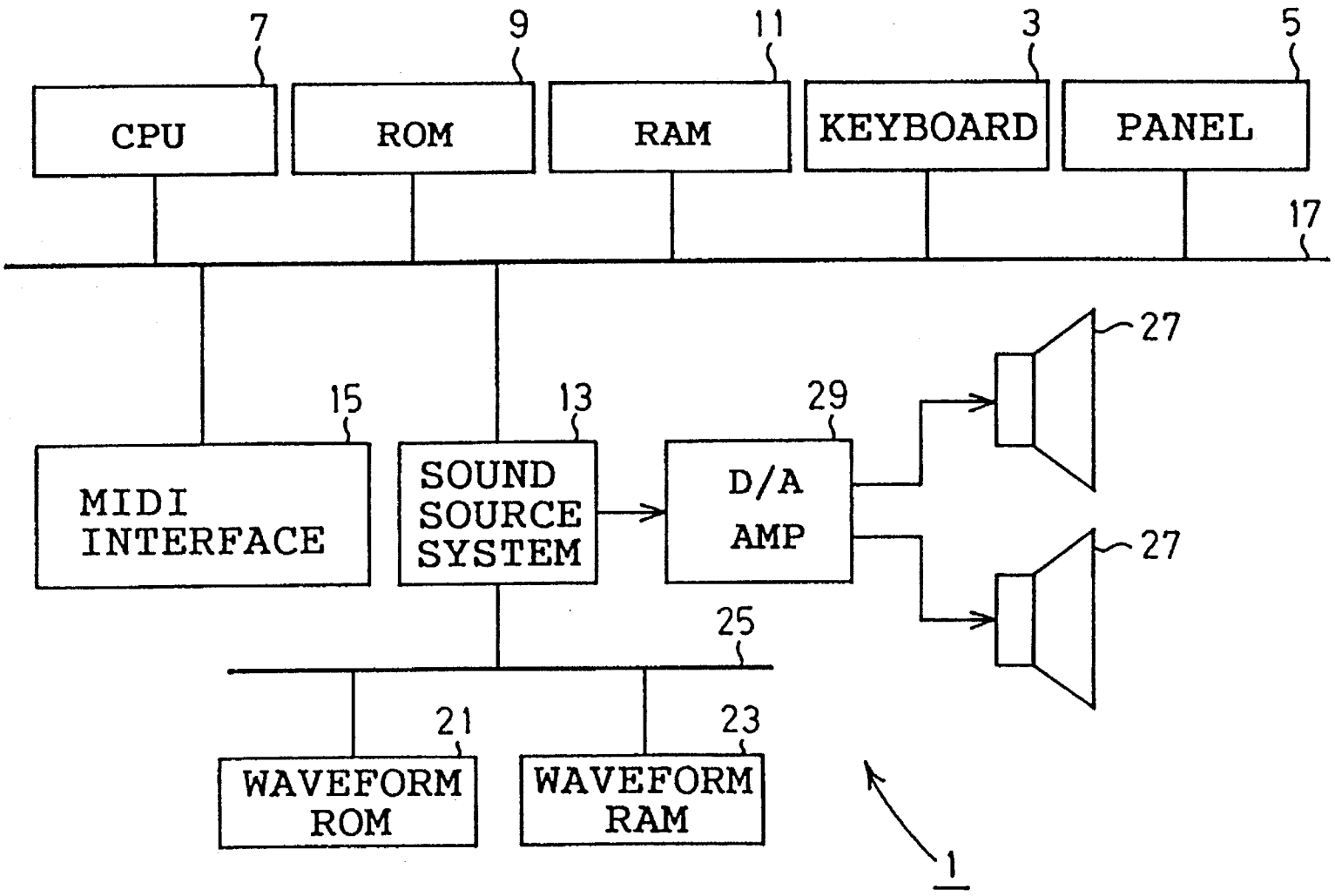
FIG. 1 is a block diagram showing the hardware structure of an electronic instrument embodying the invention.

An electronic piano 1 is, as shown in FIG. 1, provided with a keyboard 3, a panel 5, a CPU 7, a ROM 9, a RAM 11 and a sound source system 13 and an MIDI interface 15. These components are interconnected with a system bus 17. The keyboard 3 is provided with multiple keys forming given scales, and the panel 5 is provided with an electric power switch, tone selecting switch and other various switches. The signals transmitted from the keyboard 3 and the panel 5 are processed in CPU 7. ROM 9 stores programs in use for various controls executed by CPU 7. While various controls are performed by CPU 7, data is temporarily stored in RAM 11. According to the instruction given by CPU 7, sounds are generated by the sound source system 13. The MIDI interface 15 is connected to an external electronic instrument for exchanging performance data therebetween.

The sound source system 13 is connected via a system bus 25 to a waveform ROM 21 for storing the numerical waveform data and a waveform RAM 23 for developing the compressed waveform data stored in the waveform ROM 21. For the storage in the waveform ROM 21, the sound waveform of various instruments is divided into the portion of the start of sounding and the subsequent portion of sounding. The portion of the sound waveform at the start of sounding is transformed to the numerical waveform data without being compressed, and the subsequent portion of the sound waveform is compressed and transformed to the numerical data. These numerical data are stored in the respective given addresses.

The sound source system 13 is also connected via a digital-to-analog converter, amplifier or acoustic unit 29 to loudspeakers 27.

Figure 2:
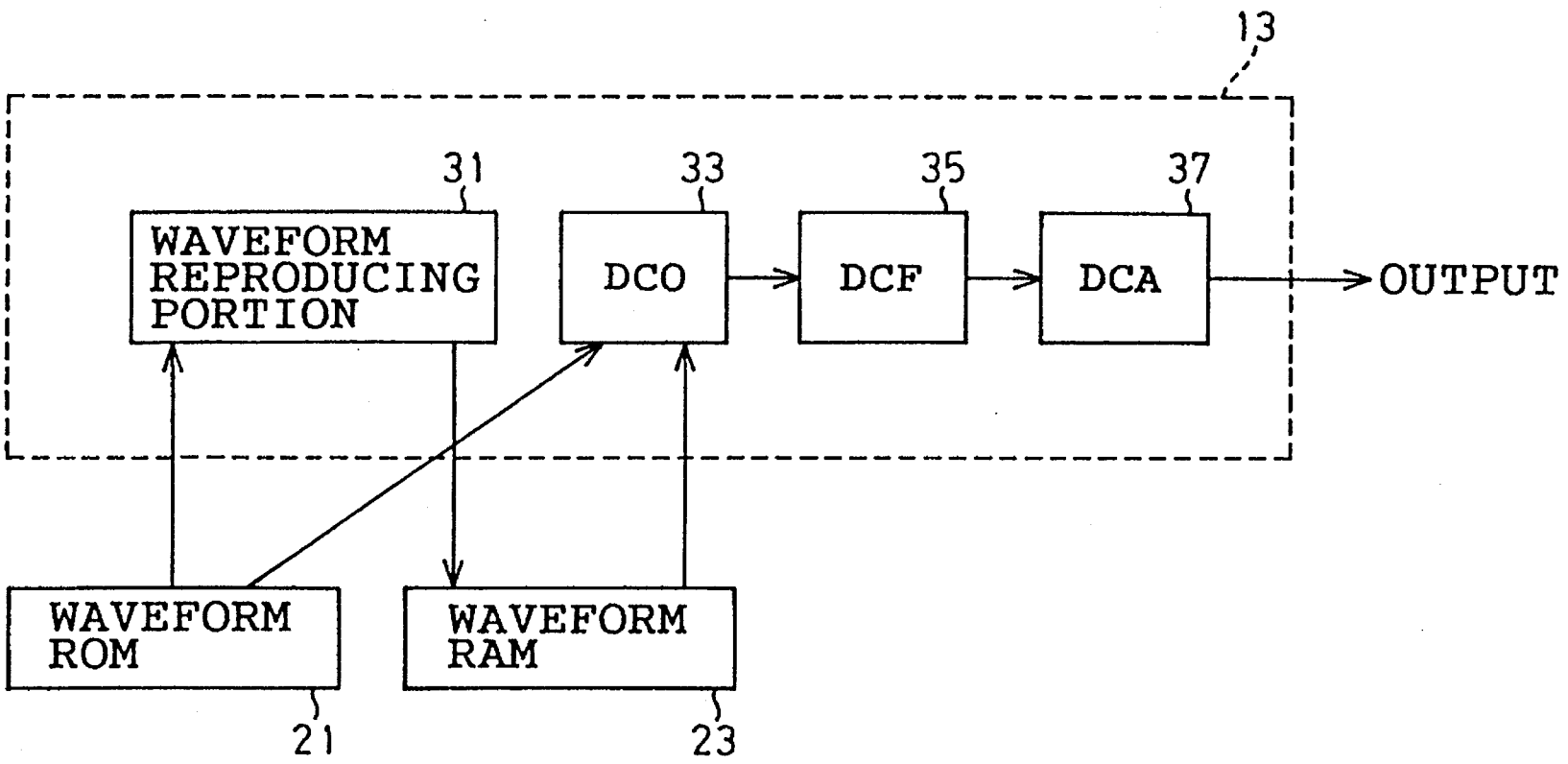
FIG. 2 is a block diagram showing the flow of signals at the time of reproduction in a sound source system.

As shown in FIG. 2, the sound source system 13 is provided with a waveform reproducing portion 31 for reproducing the sound waveform prior to the compression from the compressed numerical waveform data, and with a digital controlled oscillator 33, hereinafter referred to DCO, for reading the uncompressed waveform data at a specified rate. The sound source system 13 is also provided with a digital controlled filter 35, hereinafter referred to DCF, for removing unnecessary harmonic components from the audio signal sent from DCO 33, and with a digital controlled amplifier 37, hereinafter referred to DCA, for amplifying the audio signal sent from DCF 35 and controlling the intensity of the amplified audio signal, thereby obtaining a specified envelope.

The process for sounding in the electronic instrument 1 having the aforementioned structure is now explained with reference to the flowcharts of FIGS. 3 and 4.

Figure 3:
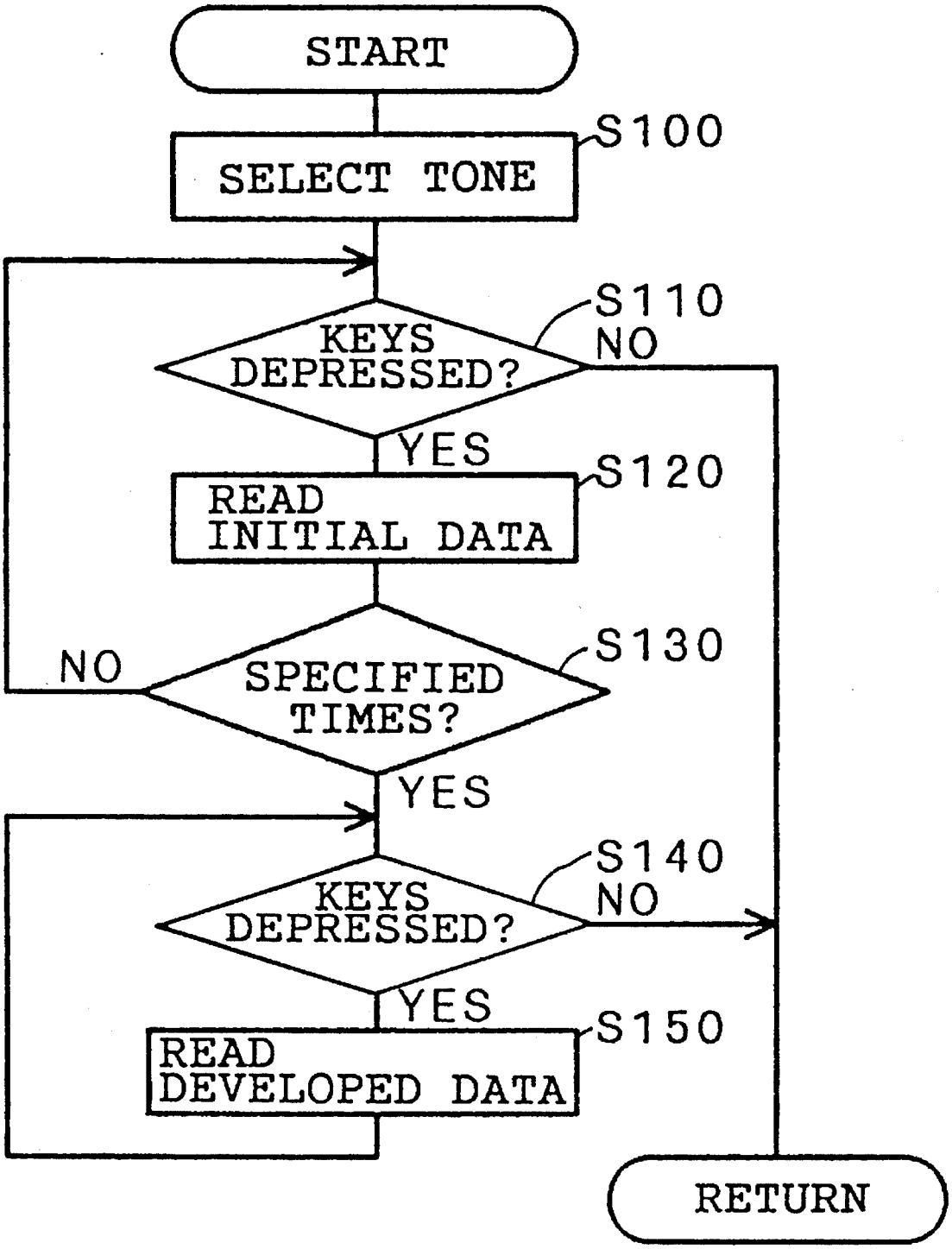
FIG. 3 is a flowchart showing the process for reading waveform data in the embodiment.

As shown in FIG. 3, the waveform data is read out. First at step S100 in response to an input signal from the MIDI interface 15, piano tone, violin tone or other specified tone is selected. The waveform data of the selected tone is divided to initial data and compressed data. The initial data corresponds to the waveform data of the portion at the start of sounding, and the compressed data corresponds to the waveform data of the subsequent portion. The initial data and the compressed data are stored in the respective addresses of the waveform ROM 21.

Subsequently, it is determined at step S110 whether or not the keys of the keyboard 3 are depressed. If the answer to step S110 is affirmative, or if the input signal is sent from the MIDI interface 15 indicating the detection of key depressing, the start address value of the initial data of the selected tone is given by DCO 33 to the waveform ROM 21. At step S120 the initial data is read from the address of the waveform ROM 21, while DCO 33 counts the number of address values at a specified rate. It is determined at step S130 whether or not the initial data value is read the specified times. If the answer to step S130 is negative, the address value is continuously given by DCO 33 to the waveform ROM 21, and the initial data values are successively read. By changing the rate of reading the initial data depending on the scale of the depressed keys, the pitch of sound is determined. The waveform signal having the pitch determined is passed through DCF 35 and DCA 37, is enveloped or otherwise processed, and is delivered as an audio signal from the sound source system 13 to the acoustic unit 29. The loudspeakers 27 are then permitted to sound. Since the initial data is uncompressed, the audio signal can be generated directly based on the read value of the initial data, thereby obviating further processing of initial data. Response time between the key depressing and the sounding is minimized.

Figure 4:
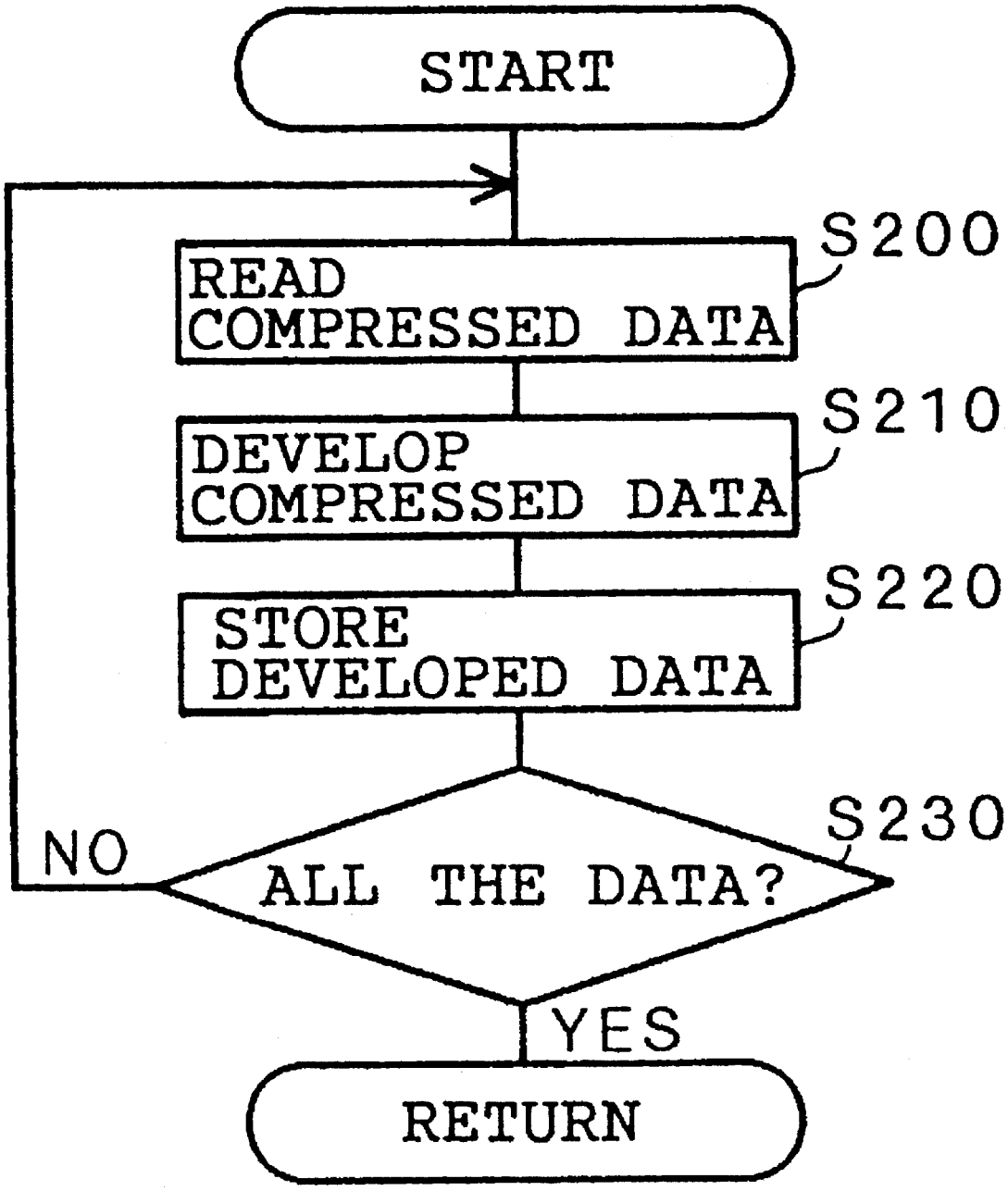
FIG. 4 is a flowchart showing the process for developing waveform data in the embodiment.

Concurrently with the aforementioned process steps S100–S130, as shown in FIG. 4, the process for developing the compressed data is carried out. First at step S200 the compressed data is read successively by transmitting the start address value of the compressed data from the waveform reproducing portion 31 to the waveform ROM 21. At step S210 the compressed data is developed by the waveform reproducing portion 31. By inverting the conversion of compressed data following a specified conversion rule, the compressed data is developed into the waveform data prior to the compression. The conversion rule for compressing the waveform data is reverse to the conversion rule for developing the compressed data. At step S220 the developed data is stored in the waveform RAM 23. It is determined at step S230 whether or not all the compressed data is developed. The process steps of S200 to S220 are repeated until the answer to step S230 becomes affirmative.

In the embodiment, the amount of the initial data used at the process steps S110–S130 is determined, such that the data development of FIG. 4 is completed at the same time the process steps of S100–S130 are completed. The longer the compressed data is developed, the more the initial data is required. By determining the amount of the initial data, time required for the data development is assured.

Turning back to the flowchart of FIG. 3, if the answer to step S130 is affirmative, it is determined that the required amount of initial data has been read. It is determined at step S140 whether or not keys are still depressed. If the answer to step S140 is affirmative, the developed data is read at step S150 by transmitting the start address value of the developed data from DCO 33 to the waveform RAM 23 in the same way when the initial data is read. The DCO 33 continuously counts the address value at a specified rate and gives the address value to the waveform RAM 23. Thus, the developed data values are successively read until the answer to step S140 becomes negative.

Through the process steps of the flowchart of FIG. 4, the developed data is inverted to the waveform data prior to compression, before being read. In the same way as the initial data, the audio signal is generated for sounding directly based on the read value of the compressed data, thereby obviating further processing of the compressed data.

The data subsequent to the initial data is compressed, and developed before being read and used. Consequently, the amount of storage is reduced, while quick response between the key depressing and the sounding is assured.

As aforementioned, in the electronic instrument 1 of the embodiment, the waveform data is partly compressed for the efficient storage. Larger amount of data can be stored, without increasing the storage capacity, different from the conventional electronic instrument. In the embodiment, waveform data can be stored for each of various tones, for each of high, medium and low sound ranges, or for each key. Consequently, various kinds of tones and the waveform data sampled over a longer period of time can be stored, so that almost the actual tones can be reproduced. The sound waveform can be sampled from each key for the storage, so that the tones subtlely varying with keys can be reproduced. Furthermore, the multiple sound waveforms different from one another in the key depressing intensity can be stored.

Since only the initial data is stored without being compressed, quick response can be assured.

The amount of the initial data is determined by the period of time required for the waveform RAM 23 to complete the development of all the compressed data. Therefore, the sounding is always based on the uncompressed data.

By reading the waveform data only from the waveform ROM 21, the sound source system of the invention can be used for the conventional sound generating system.

This invention has been described above with reference to the preferred embodiment as shown in the figure. Modifications and alterations may become apparent to one skilled in the art upon reading and understanding the specification. Despite the use of the embodiment for illustration purposes, the invention is intended to include all such modifications and alterations within the spirit and scope of the appended claims.

In this spirit, the basis of determining the amount of the initial data is not limited to the period of time required for the development of all the compressed data. For example, the amount of the initial data can be adjusted to the time period required for storing a specified amount of developed data into the waveform RAM. The reading of the waveform data from the waveform RAM is proceeded to follow the development of the compressed data to the waveform RAM. In this structure, the percentage of the compressed data in all the waveform data is increased, and the memory can be used efficiently.

Furthermore, without passing the waveform RAM, the waveform data reproduced by the waveform reproducing portion can be transmitted directly to DCO. In this case, the data compression system needs to be adapted such that the period of time required for the data development does not cause any problem.

What is claimed is:

1. A sound source system comprising:

an initial waveform storage means for storing the sound waveform of the start of sounding without compressing said sound waveform;

a compressed waveform storage means for storing the sound waveform subsequent to the start of sounding as the compressed numerical data;

a waveform reproducing means for developing the compressed data stored in said compressed waveform storage means and reproducing a sound waveform; and a sound signal generating means for at first generating a sound signal based on the sound waveform stored in said initial waveform storage means and subsequently generating a sound signal based on the sound waveform reproduced by said waveform reproducing means.

2. An electronic instrument comprising:

an initial waveform storage means for storing the sound waveform of the start of sounding without compressing said sound waveform;

a compressed waveform storage means for storing the sound waveform subsequent to the start of sounding as the compressed numerical data;

a waveform reproducing means for developing the compressed data stored in said compressed waveform storage means and reproducing a sound waveform;

a sound signal generating means for at first generating a sound signal based on the sound waveform stored in said initial waveform storage means and subsequently generating a sound signal based on the sound waveform reproduced by said waveform reproducing means; and an amplifying output means for amplifying the sound signal generated by said sound signal generating means for output.

3. The electronic instrument according to claim 2, wherein the sound waveform stored in said initial waveform storage means is determined for each range of predetermined sound pitches.

4. The electronic instrument according to claim 2, wherein the sound waveform stored in said initial waveform storage means is determined for each predetermined tone.

5. The electronic instrument according to claim 2, wherein the amount of data stored in said initial waveform storage means is determined by the period of time required till the development of data is completed by said waveform reproducing means.

6. An electronic instrument, comprising:

an initial waveform storage means for storing the sound waveform of the start of sounding without compressing said sound waveform;

a compressed waveform storage means for storing the sound waveform subsequent to the start of sounding as the compressed numerical data;

a detecting means for detecting the operation of keys;

an initial waveform reading means for reading out the sound waveform from said initial waveform storage means in response to the detection of said detecting means;

a waveform reproducing means for developing the compressed data stored in said compressed waveform storage means concurrency with the reading of said initial waveform reading means;

a sound signal generating means for at first generating a sound signal based on the sound waveform read out by said initial waveform reading means and subsequently generating a sound signal based on the sound waveform reproduced by said waveform reproducing means; and an amplifying output means for amplifying the sound signal generated by said sound signal generating means for output.

7. The electronic instrument according to claim 6, which further comprises a reproduced waveform storage means for storing the sound waveform reproduced by said waveform reproducing means, wherein said reproduced waveform storage means stores a predetermined amount of sound waveform data, when the reading of sound waveform is completed by said initial waveform reading means, and the sound waveform data is read from said reproduced waveform storage means, concurrently when the sound waveform developed by said waveform reproducing means is stored into said reproduced waveform storage means.

8. The electronic instrument according to claim 6, wherein the sound waveform stored in said initial waveform storage means is determined for each range of predetermined sound pitches.

9. The electronic instrument according to claim 6, wherein the sound waveform stored in said initial waveform storage means is determined for each predetermined tone.

* * * * *